US011386866B2

(12) United States Patent
Sin et al.

(10) Patent No.: US 11,386,866 B2
(45) Date of Patent: Jul. 12, 2022

(54) ELECTRONIC DEVICE AND SCREEN REFRESH METHOD THEREOF

(71) Applicant: Samsung Electronics Co., Ltd., Suwon-si (KR)

(72) Inventors: Youngcheol Sin, Suwon-si (KR); Daehyun Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/150,720

(22) Filed: Jan. 15, 2021

(65) Prior Publication Data

US 2021/0225320 A1 Jul. 22, 2021

(30) Foreign Application Priority Data

Jan. 16, 2020 (KR) ..... 10-2020-0006125

(51) Int. Cl.
*G08G 5/00* (2006.01)
*G09G 5/00* (2006.01)

(52) U.S. Cl.
CPC ..... *G09G 5/003* (2013.01); *G09G 2310/08* (2013.01); *G09G 2320/0252* (2013.01); *G09G 2354/00* (2013.01); *G09G 2360/18* (2013.01)

(58) Field of Classification Search
CPC ..... G09G 5/003; G09G 2310/08; G09G 2320/0252; G09G 2354/00; G09G 2360/18
See application file for complete search history.

(56) References Cited

U.S. PATENT DOCUMENTS 7,548,233 B1 6/2009 Lee et al.
7,903,107 B2 3/2011 Ostlund
9,741,284 B2 8/2017 Kim
9,830,880 B1 11/2017 Wyatt
2013/0141642 A1* 6/2013 Wu ..... G09G 5/363 348/E7.001
2016/0093239 A1 3/2016 Wang et al.
2016/0203755 A1 7/2016 Kim
2016/0247484 A1 8/2016 Chen et al.
2016/0293132 A1 10/2016 Zhang
2018/0277054 A1 9/2018 Colenbrander
2019/0141374 A1* 5/2019 McAuley ..... H04N 19/172
2019/0184284 A1 6/2019 Quere et al.
2020/0348750 A1* 11/2020 Selan ..... G09G 3/3208

FOREIGN PATENT DOCUMENTS

KR 10-2062724 B1 1/2020

OTHER PUBLICATIONS

Song, Byung Cheol, "A Virtual Frame Rate Control Algorithm for Efficient MPEG-2 Video Encoding", May 2003, "IEEE Transactions an Consumer Electronics" vol. 49, pp. 460-465 (Year: 2003).*
International Search Report of the International Searching Authority in connection with International Application No. PCT/KR2021/000608 dated May 4, 2021, 3 pages.

* cited by examiner

*Primary Examiner* — Terrell M Robinson

(57) ABSTRACT

An electronic device may include a display, and a processor operatively connected to the display. The processor is configured to identify a frame rate of a first application that is currently being executed. The processor is also configured to, based on the frame rate, determine a scanning rate of the display and a frame refresh rate for refreshing a frame related to the first application. The processor is further configured to control a first screen refresh of the first application, based on the scanning rate and the frame refresh rate.

20 Claims, 9 Drawing Sheets

ELECTRONIC DEVICE AND SCREEN REFRESH METHOD THEREOF

CROSS-REFERENCE TO RELATED APPLICATION

This application is based on and claims priority under 35 U.S.C. 119 to Korean Patent Application No. 10-2020-0006125, filed on Jan. 16, 2020, in the Korean Intellectual Property Office, the disclosure of which is herein incorporated by reference in its entirety.

BACKGROUND

1. Field

Various embodiments relate to an electronic device and a screen refresh method thereof.

2. Description of Related Art

Electronic devices (for example, mobile terminals, smartphones, or wearable terminals) may provide various functions (for example, a music playback function, a navigation function, a short-range wireless communication (for example, Bluetooth, Wi-Fi, or near-field communication (NFC)) function, a fingerprint recognition function, and an electronic payment function).

In addition, electronic devices may output various screens through displays. For example, electronic devices may output application execution screens through displays. In general, an application may refresh frames at a designated frame rate (for example, 60 frame per second (FPS)). In addition, an electronic device may refresh its screen in each designated period (for example, 60 Hz). For example, an electronic device may refresh its screen based on a synchronization signal (for example, Vsync) having a designated period. The synchronization signal may include a first synchronization signal related to generation of a frame to be provided to the display, and a second synchronization signal related to the screening rate of the display. The first synchronization signal may be controlled on a software basis, and the second synchronization signal may be controlled on a hardware basis. The first synchronization signal and the second synchronization signal may have the same period.

The above information is presented as background information only to assist with an understanding of the disclosure. No determination has been made, and no assertion is made, as to whether any of the above might be applicable as prior art with regard to the disclosure.

SUMMARY

However, a specific application (for example, a game application) that outputs high-quality images may output frames at a low frame rate (for example, 40 FPS). If the frame rate of an application is low like this, the frame generation time (for example, a frame draw time) may become longer than the period of the synchronization signal, and a frame drop may then occur in the electronic device. Such a frame drop may result in a latency delay regarding the user's interaction.

If the period of the synchronization signal is configured identical to the frame rate of the application (for example, 40 Hz), no frame drop may occur, but the period of the synchronization signal increases from about 16.67 ms (=1/60) to 25 ms (=1/40), thereby causing a latency delay regarding the user's interaction.

If the period of the synchronization signal is configured to be a multiple (for example, 80 Hz) of the frame rate (for example, 40 FPS) of the application, the latency delay may be removed, but the frame generation time may become longer than the period of the synchronization signal (12.5 ms (=1/80)), thereby causing a frame drop.

Various embodiments may provide an electronic device capable of preventing a frame drop and/or a latency delay, and a screen refresh method thereof.

An electronic device according to various embodiments may include, for example: a display; and a processor operatively connected to the display, wherein the processor is configured to: identify a frame rate of a first application that is currently being executed, based on the frame rate, determine a scanning rate of the display and a frame refresh rate for refreshing a frame related to the first application, and control a first screen refresh of the first application, based on the scanning rate and the frame refresh rate.

A screen refresh method of an electronic device may include, for example, the operations of: identifying a frame rate of a first application that is currently being executed; determining a scanning rate of a display, based on the frame rate; determining a frame refresh rate for refreshing a frame related to the first application, based on the determined scanning rate; and controlling a first screen refresh of the first application, based on the determined scanning rate and the determined frame refresh rate.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
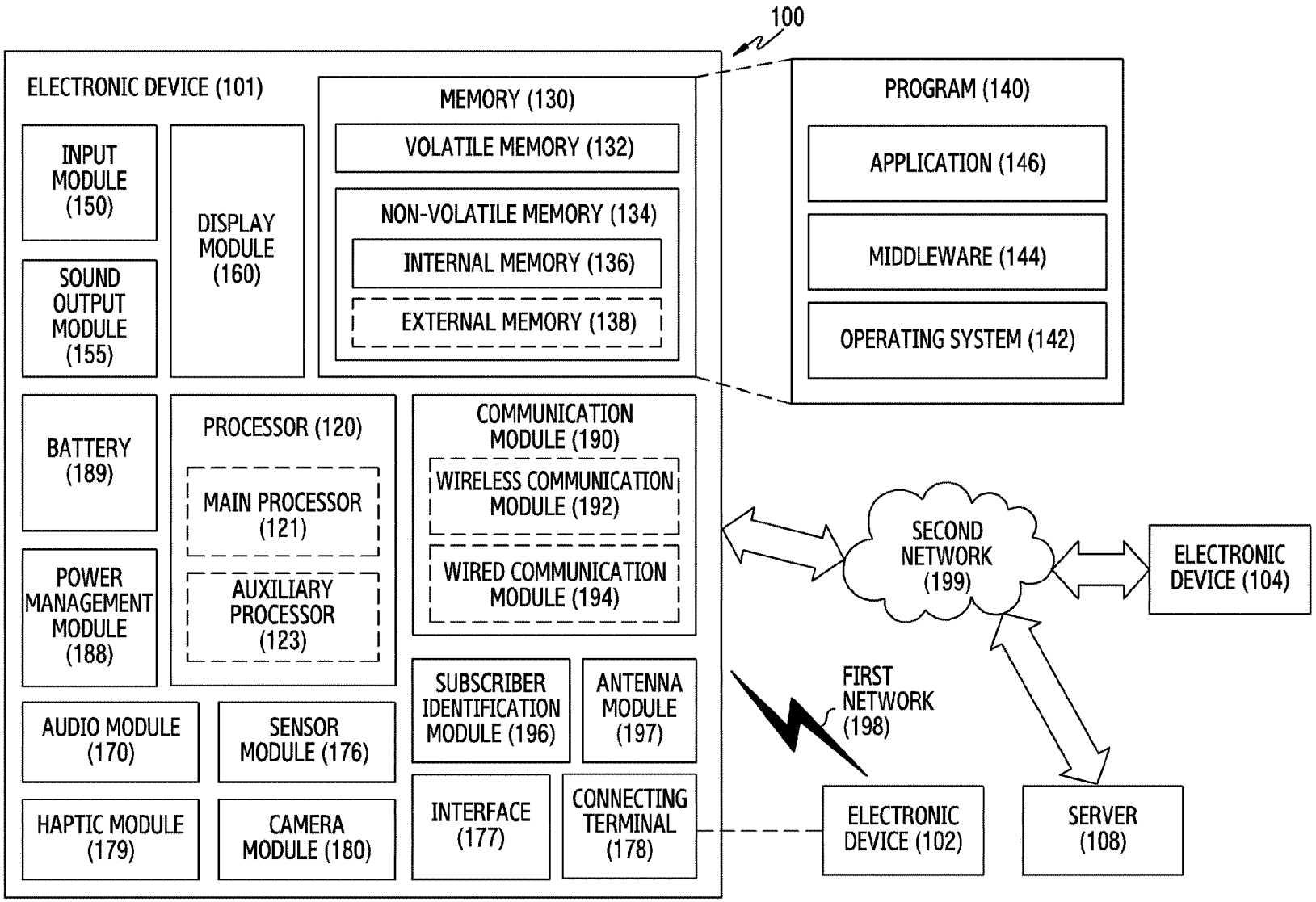
FIG. 1 illustrates a block diagram of an electronic device in a network environment according to an embodiment.

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, various embodiments will be described with reference to the accompanying drawings. In the disclosure, specific embodiments are illustrated in the drawings and the related detailed descriptions are provided, but this is not intended to limit various embodiments to a specific form. For example, a person skilled in the art to which the disclosure belongs can appreciate that embodiments can be variously changed.

FIG. 1 illustrates a block diagram illustrating an electronic device 101 in a network environment 100 according to various embodiments.

Referring to FIG. 1, the electronic device 101 in the network environment 100 may communicate with an electronic device 102 via a first network 198 (e.g., a short-range wireless communication network), or at least one of an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input module 150, a sound output module 155, a display module 160, an audio module 170, a sensor module 176, an interface 177, a connecting terminal 178, a haptic module 179, a camera module 180, a power management module 188, a battery 189, a communication module 190, a subscriber identification module (SIM) 196, or an antenna module 197. In some embodiments, at least one of the components (e.g., the connecting terminal 178) may be omitted from the electronic device 101, or one or more other components may be added in the electronic device 101. In some embodiments, some of the components (e.g., the sensor module 176, the camera module 180, or the antenna module 197) may be implemented as a single component (e.g., the display module 160).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may store a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), or an auxiliary processor 123 (e.g., a graphics processing unit (GPU), a neural processing unit (NPU), an image signal processor (ISP), a sensor hub processor, or a communication processor (CP)) that is operable independently from, or in conjunction with, the main processor 121. For example, when the electronic device 101 includes the main processor 121 and the auxiliary processor 123, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display module 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123. According to an embodiment, the auxiliary processor 123 (e.g., the neural processing unit) may include a hardware structure specified for artificial intelligence model processing. An artificial intelligence model may be generated by machine learning. Such learning may be performed, e.g., by the electronic device 101 where the artificial intelligence is performed or via a separate server (e.g., the server 108). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input module 150 may receive a command or data to be used by another component (e.g., the processor 120) of the electronic device 101, from the outside (e.g., a user) of the electronic device 101. The input module 150 may include, for example, a microphone, a mouse, a keyboard, a key (e.g., a button), or a digital pen (e.g., a stylus pen).

The sound output module 155 may output sound signals to the outside of the electronic device 101. The sound output module 155 may include, for example, a speaker or a receiver. The speaker may be used for general purposes, such as playing multimedia or playing record. The receiver may be used for receiving incoming calls. According to an embodiment, the receiver may be implemented as separate from, or as part of the speaker.

The display module 160 may visually provide information to the outside (e.g., a user) of the electronic device 101. The display module 160 may include, for example, a display, a hologram device, or a projector and control circuitry to control a corresponding one of the display, hologram device, and projector. According to an embodiment, the display module 160 may include a touch sensor adapted to detect a touch, or a pressure sensor adapted to measure the intensity of force incurred by the touch.

The audio module 170 may convert a sound into an electrical signal and vice versa. According to an embodiment, the audio module 170 may obtain the sound via the input module 150, or output the sound via the sound output module 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as BLUETOOTH, wireless-fidelity (Wi-Fi) direct, or infrared data association (IrDA)) or the second network 199 (e.g., a long-range communication network, such as a legacy cellular network, a 5G network, a next-generation communication network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The wireless communication module 192 may support a 5G network, after a 4G network, and next-generation communication technology, e.g., new radio (NR) access technology. The NR access technology may support enhanced mobile broadband (eMBB), massive machine type communications (mMTC), or ultra-reliable and low-latency communications (URLLC). The wireless communication module 192 may support a high-frequency band (e.g., the mmWave band) to achieve, e.g., a high data transmission rate. The wireless communication module 192 may support various technologies for securing performance on a high-frequency band, such as, e.g., beamforming, massive multiple-input and multiple-output (massive MIMO), full dimensional MIMO (FD-MIMO), array antenna, analog beam-forming, or large scale antenna. The wireless communication module 192 may support various requirements specified in the electronic device 101, an external electronic device (e.g., the electronic device 104), or a network system (e.g., the second network 199). According to an embodiment, the wireless communication module 192 may support a peak data rate (e.g., 20 Gbps or more) for implementing eMBB, loss coverage (e.g., 164 dB or less) for implementing mMTC, or U-plane latency (e.g., 0.5 ms or less for each of downlink (DL) and uplink (UL), or a round trip of 1 ms or less) for implementing URLLC.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., a printed circuit board (PCB)). According to an embodiment, the antenna module 197 may include a plurality of antennas (e.g., array antennas). In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

According to various embodiments, the antenna module 197 may form a mmWave antenna module. According to an embodiment, the mmWave antenna module may include a printed circuit board, a RFIC disposed on a first surface (e.g., the bottom surface) of the printed circuit board, or adjacent to the first surface and capable of supporting a designated high-frequency band (e.g., the mmWave band), and a plurality of antennas (e.g., array antennas) disposed on a second surface (e.g., the top or a side surface) of the printed circuit board, or adjacent to the second surface and capable of transmitting or receiving signals of the designated high-frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 or 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, mobile edge computing (MEC), or client-server computing technology may be used, for example. The electronic device 101 may provide ultra low-latency services using, e.g., distributed computing or mobile edge computing. In another embodiment, the external electronic device 104 may include an internet-of-things (IoT) device. The server 108 may be an intelligent server using machine learning and/or a neural network. According to an embodiment, the external electronic device 104 or the server 108 may be included in the second network 199. The electronic device 101 may be applied to intelligent services (e.g., smart home, smart city, smart car, or healthcare) based on 5G communication technology or IoT-related technology.

For the convenience of description, various embodiments will be described below by using a screen refresh of Android OS™ as an example. However a person skilled in the art can appreciate that various embodiments can be applied to a screen refresh of various OSs (e.g., iOS™, Window OS™, Mac OS™, Symbian OS™, Tizen OS™, and Bada OS™).

Figure 2:
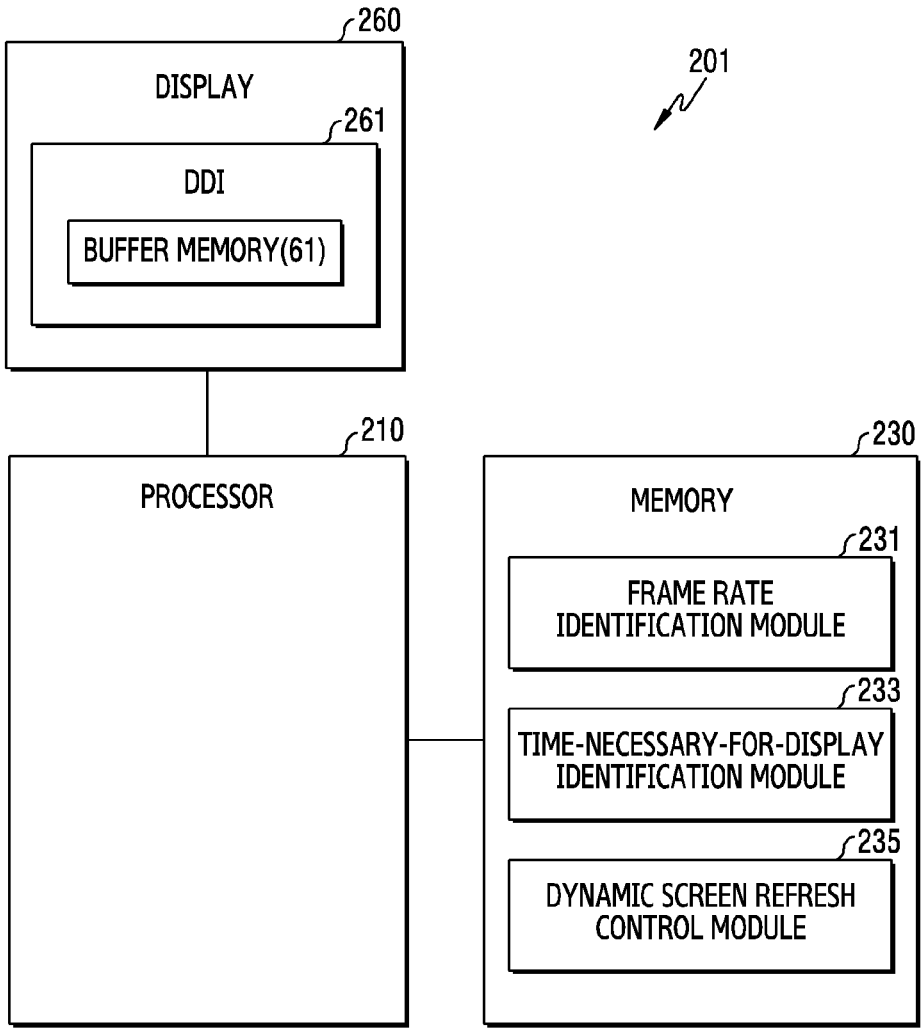
FIG. 2 illustrates a block diagram of a configuration of an electronic device according to an embodiment.

FIG. 2 illustrates a block diagram of a configuration of an electronic device according to an embodiment.

Referring to FIG. 2, an electronic device 201 (e.g., the electronic device 101 of FIG. 1) according to an embodiment may include a processor 210 (e.g., the processor 120 of FIG. 1), a memory 230 (e.g., the memory 130 of FIG. 1), and a display 260 (e.g., the display module 160 of FIG. 1).

The processor 210 according to various embodiments may dynamically control a screen refresh. For example, the processor 210 may control a screen refresh, based on a first synchronization signal and a second synchronization signal which have a dynamically changing period. The first synchronization signal may be related to generation of a frame to be provided to the display 260, and the second synchronization signal may be related to a scanning rate of the display 260. A period of the first synchronization signal (hereinafter, may be referred to as a first synchronization period or a frame refresh rate) may be controlled by software, and a period of the second synchronization signal (hereinafter, may be referred to as a second synchronization period or a scanning rate) may be controlled by hardware. For example, the processor 210 may directly control the first synchronization signal, and indirectly control the second synchronization signal through the display 260. The first synchronization signal and the second synchronization signal may have different periods.

According to various embodiments, the first synchronization signal may be software vertical-sync (SW Vsync) for enabling a graphic processing device (e.g., a graphic processor unit (GPU) and an image signal processor (ISP)) to refresh a frame buffer, and the second synchronization signal may be hardware vertical-sync (HW Vsync) for refreshing a screen of the display 260.

The processor 210 according to various embodiments may identify a frame rate (frame per second: FPS) (or may be referred to as a draw rate) of a currently executed application, under the control of a frame rate identification module 231, and dynamically configure a first synchronization period (or may be referred to as a frame refresh rate) and/or a second synchronization period (or may be referred to as a scanning rate), based on the identified frame rate, under the control of a dynamic screen refresh control module 235. For example, the processor 210 may configure the second synchronization period so as to correspond to a scanning rate which has the smallest difference from a multiple of the frame rate of the currently executed application, among scanning rates supported by the display 260, under the control of the dynamic screen refresh control module 235, and may configure the first synchronization period so as to correspond to a value which is smaller than and has the smallest difference from the frame rate of the currently executed application, among divisors of the configured second synchronization period.

According to various embodiments, the frame rate identification module 231 and the screen refresh control module 235 may be implemented as software (e.g., the program 140) and stored in the memory 230.

The processor 210 according to various embodiments may dynamically configure a first synchronization period and a second synchronization period, based on a frame rate, as shown in Table 1 below. Table 1 assumes that the display 260 supports scanning rates of 30 Hz, 48 Hz, 60 Hz, 90 Hz, 96 Hz, and 120 Hz.

TABLE 1

| FPS | 2 times | 3 times | 4 times | Second synchronization period | First synchronization period |
|---|---|---|---|---|---|
| 30 | 60 | 90 | 120 | 30/60/90/120 Hz | 30/30/30/30 Hz |
| 31 | 62 | 93 | 124 | 60 Hz | 30 Hz |
| 32 | 64 | 96 | 128 | 96 Hz | 32 Hz |
| 33 | 66 | 99 | 132 | 96 Hz | 32 Hz |
| 34 | 68 | 102 | 136 | 96 Hz | 32 Hz |
| 35 | 70 | 105 | 140 | 96 Hz | 32 Hz |
| 36 | 72 | 108 | 144 | 60/96/120 Hz | 30/32/30 Hz |
| 37 | 74 | 111 | 148 | 120 Hz | 30 Hz |
| 38 | 76 | 114 | 152 | 120 Hz | 30 Hz |
| 39 | 78 | 117 | 156 | 120 Hz | 30 Hz |
| 40 | 80 | 120 | 160 | 120 Hz | 40 Hz |
| 41 | 82 | 123 | 164 | 120 Hz | 40 Hz |
| 42 | 84 | 126 | 168 | 90/120 Hz | 30/40 Hz |
| 43 | 86 | 129 | 172 | 90 Hz | 30 Hz |
| 44 | 88 | 132 | 176 | 90 Hz | 30 Hz |
| 45 | 90 | 135 | 180 | 90 Hz | 45 Hz |
| 46 | 92 | 138 | 184 | 90 Hz | 45 Hz |
| 47 | 94 | 141 | 188 | 96 Hz | 32 Hz(48 Hz) |
| 48 | 96 | 144 | 192 | 96 Hz | 48 Hz |
| 49 | 98 | 147 | 196 | 96 Hz | 48 Hz |
| 50 | 100 | 150 | 200 | 96 Hz | 48 Hz |
| 51 | 102 | 153 | 204 | 96 Hz | 48 Hz |
| 52 | 104 | 156 | 208 | 96 Hz | 48 Hz |
| 53 | 106 | 159 | 212 | 96 Hz | 48 Hz |
| 54 | 108 | 162 | 216 | 96/120 Hz | 48/40 Hz |
| 55 | 110 | 165 | 220 | 120 Hz | 40 Hz |
| 56 | 112 | 168 | 224 | 120 Hz | 40 Hz |
| 57 | 114 | 171 | 228 | 120 Hz | 40 Hz |
| 58 | 116 | 174 | 232 | 120 Hz | 40 Hz |
| 59 | 118 | 177 | 236 | 120 Hz | 40 Hz |
| 60 | 120 | 180 | 240 | 120 Hz | 60 Hz |
| 61 | 122 | 183 | 244 | 120 Hz | 60 Hz |
| 62 | 124 | 186 | 248 | 120 Hz | 60 Hz |
| 63 | 126 | 189 | 252 | 120 Hz | 60 Hz |
| 64 | 128 | 192 | 256 | 120 Hz | 60 Hz |
| 65 | 130 | 195 | 260 | 120 Hz | 60 Hz |
| 66 | 132 | 198 | 264 | 120 Hz | 60 Hz |

TABLE 1-continued

| FPS | 2 times | 3 times | 4 times | Second synchronization period | First synchronization period |
|---|---|---|---|---|---|
| 67 | 134 | 201 | 268 | 120 Hz | 60 Hz |
| 68 | 136 | 204 | 272 | 120 Hz | 60 Hz |
| 69 | 138 | 207 | 276 | 120 Hz | 60 Hz |
| 70 | 140 | 210 | 280 | 120 Hz | 60 Hz |

Referring to Table 1 above, in the case where the frame rate of the currently executed application is 43 FPS, the processor 210 may determine, under the control of the dynamic screen refresh control module 235, that, among the scanning rates (30 Hz, 48 Hz, 60 Hz, 90 Hz, 96 Hz, and 120 Hz) supported by the display 260, 90 Hz has the smallest difference from 86 (=43*2) Hz and 129 (=43*3) Hz, which are multiples of 43 (for example, 4 (=90−86) vs 9 (=129−120)), and thus is configured as the second synchronization period. The processor 210 may determine, under the control of the dynamic screen refresh control module 235, that, among 45 (=90/2) Hz, 30 (=90/3) Hz, and 18 (=90/5) Hz which correspond to divisors of the configured second synchronization period (90 Hz), 30 Hz is smaller than the frame rate and has the smallest difference from the frame rate, and thus is configured as the first synchronization period. According to an embodiment, the processor 210 may determine one of divisors of the configured second synchronization period as the first synchronization period, even if the same is larger than the frame rate, as long as the difference therefrom is within a specified range (for example, 3 Hz or less). For example, in the case of 47 FPS in Table 1 above, the first synchronization period may be configured to be 48 Hz which is larger than 47 FPS, but is within a specified range.

According to various embodiments, in the case where there are a plurality of configurable first synchronization periods and/or second synchronization periods, the processor 210 may configure a first synchronization period and/or a second synchronization period in consideration of current consumption and/or the performance (for example, uniformity and importance of latency) of the electronic device. Meanwhile, Table 1 above is only an example and does not limit the disclosure.

According to an embodiment, the processor 210 may not configure the second synchronization period to have a value having the smallest difference from a multiple of the frame rate, but may configure the second synchronization period to have a next-ranked value, in consideration of the current consumption. For example, in the case where the frame rate is 40 FPS, the processor 210 is used to configure the first synchronization period to correspond to 120 which is 3 times 40, but in the case where a problem occurs in the current consumption when the display 260 operates at 120 Hz, the processor may configure the second synchronization period to be 90 Hz which has the smallest difference from 80 which is 2 times 40. According to an embodiment, the processor 210 may configure 120 Hz as the second synchronization period when the remaining amount of a battery is equal to or greater than a specified ratio (for example, 50%), and configure 90 Hz as the second synchronization period when the remaining amount of the battery is less than the specified ratio (for example, 50%).

The processor 210 according to various embodiments may identify a time for a frame generated in relation to the currently executed application to be actually displayed on the display 260 (hereinafter, referred to as a time for display)

under the control of a time-necessary-for-display identification module 233, and dynamically control (for example, configure) an offset value according to the identified time for display, under the control of the dynamic screen refresh control module 235. The time for display may include a layer synthesis time and/or a buffering time. For example, in the case of Android OS™, one screen (frame) may include multiple layers, and the time for display may include a time when a specific module (e.g., a SurfaceFlinger module) synthesizes each layer to generate one screen (frame), and/or a time for storing the generated screen (frame) in a buffer memory 61 of a display driver integrated circuit (DDI) 261. The offset value may be a value for reducing a waiting time until the second synchronization period in which the generated screen (frame) is completely stored in the buffer memory 61 and then output on the display 260. For example, in the case where the time for display is short (for example, equal to or less than ⅔ of the second synchronization period), the processor 210 may configure an offset to have a first value (for example, a relatively large value compared to a second value) to reduce the waiting time until the second synchronization period, under the control of the dynamic screen refresh control module 235. In the case where the time for display is long (for example, more than ⅔ of the second synchronization period), the processor 210 may configure or may not configure the offset to have the second value (for example, a relatively small value compared to the first value) since the waiting time until the second synchronization period is short. According to various embodiments, the processor 210 may configure an offset by controlling a phase of the first synchronization signal or the second synchronization signal under the control of the dynamic screen refresh control module 235. The electronic device 201 according to various embodiments can prevent latency delay for user interaction through a dynamic control of the offset.

According to various embodiments, the time-necessary-for-display identification module 233 may be implemented as software (e.g., the program 140) and stored in the memory 230.

According to various embodiments, an offset value may indicate a time for outputting, on the display 260, a screen (frame) having been stored in the buffer memory 61, prior to the second synchronization period as much as a value configured as the offset.

The processor 210 according to various embodiments may periodically identify the frame rate of the currently executed application, and dynamically change the first synchronization period, the second synchronization period, and/or the offset if necessary (for example, when the frame rate and/or the time for display is changed by a specified value or more). Further, when the currently executed application is changed (for example, another application is executed), the processor 210 may dynamically change the first synchronization period, the second synchronization period, and/or the offset, based on the time for display and/or the frame rate of the changed application.

The memory 130 according to various embodiments may include the frame rate identification module 231, the time-necessary-for-display identification module 233, and/or the dynamic screen refresh control module 235.

According to an embodiment, the frame rate identification module 231 may identify a frame rate of a currently executed application (or app). For example, in the case of Android OS™, the frame rate identification module 231 may identify the frame rate of the currently executed application, through systrace information or gfxinfo information (e.g., janky frames). A person skilled in the art can appreciate that various information can be used according to the type of OS.

According to an embodiment, the frame rate identification module 231 may determine one of a frame rate designated by a user with regard to each application, a frame rate stored in a use history, a maximum frame rate, or an average frame rate as the frame rate of the currently executed application. According to another embodiment, the frame rate identification module 231 may determine the frame rate of the currently executed application, based on big data with respect to the currently executed application or information collected through machine learning. For example, the frame rate identification module 231 may store a change history of a frame rate with regard to each application (e.g., big data), and manage the change history through machine learning. Alternatively, the frame rate identification module 231 may receive machine learning information or big data with respect to the frame rate of the application from a server. According to another embodiment, the frame rate identification module 231 may determine the frame rate, based on a state (e.g., loading, a specific mode (e.g., a manual combat or an automatic combat), and an idle screen) of the application. The memory 230 may store a frame rate with regard to each state of the application in a table format.

According to an embodiment, the time-necessary-for-display identification module 233 may identify a time for a screen (frame) generated by a specific module (e.g., a SurfaceFlinger module) to be actually displayed on the display 260. The time for display may include a layer synthesis time and/or a buffering time. For example, in the case of Android OS', one screen (frame) may include multiple layers, and the time for display may include a time when a specific module (e.g., a SurfaceFlinger module) synthesizes each layer to generate one screen (frame) and/or a time for storing the generated screen (frame) in the buffer memory 61 of the display driver integrated circuit 261.

According to an embodiment, the time-necessary-for-display identification module 233 may identify the time for display, through a difference between a time when generation of a frame (or synthesis of layers) related to the currently executed application is started and a time when the frame is completely stored in the buffer memory 61. According to an embodiment, the time-necessary-for-display identification module 233 may identify (calculate) the time for display, based on the number of layers to be synthesized to generate one screen (frame) and whether a graphic processing device (e.g., a graphic processor unit (GPU) and an image signal processor (ISP)) is used. According to another embodiment, the time-necessary-for-display identification module 233 may determine the time for display of the currently executed application, based on big data with respect to the currently executed application or information collected through machine learning.

According to an embodiment, the dynamic screen refresh control module 235 may dynamically determine a first synchronization period, a second synchronization period, and/or an offset for a screen refresh. For example, as shown in Table 1, the dynamic screen refresh control module 235 may determine the first synchronization period and the second synchronization period, based on a frame rate of the currently executed application. In addition, the dynamic screen refresh control module 235 may determine the offset based on the time for display of the currently executed application.

According to an embodiment, the dynamic screen refresh control module 235 may control a screen refresh (for example, configure an optimized pipeline), based on the determined first synchronization period, second synchronization period, and/or offset.

The display 260 according to various embodiments may display various screens (images). The display 260 according to an embodiment may include the display driver integrated circuit 261. The display driver integrated circuit 261 may include the buffer memory 61 which stores an image in units of frames. FIG. 2 illustrates that the buffer memory 61 is included in the display driver integrated circuit 261. However, according to an embodiment, the buffer memory 61 may be included in the memory 230 or may be separately included in the display 260 or a main printed circuit board (not shown).

In addition, although not shown, the display driver integrated circuit 261 may include an interface module (not shown) which receives image data, or image information including an image control signal corresponding to a command for controlling the image data, an image processing module (not shown) which performs pre-processing or post-processing (for example, resolution, brightness, or size adjustment) of at least a part of the image data, based on a characteristic of the image data or a characteristic of the display 260, or a mapping module (not shown) which generates a voltage value or a current value corresponding to the pre-processed or post-processed image data.

In addition, according to an embodiment, the display 260 may further include a touch circuit (not shown) and/or a sensor module (not shown). For example, the touch circuit may control detection of a touch input or a hovering input with respect to a specific location of the display 260. For example, the touch circuit may detect a touch input or a hovering input by measuring a change in a signal (e.g., a voltage, an amount of light, a resistance, or an amount of charge) with respect to a specific location of the display 260. The sensor module may include at least one sensor (e.g., a fingerprint sensor, an iris sensor, a pressure sensor, or an illuminance sensor). The sensor module may be embedded in a part of the display 260, the display driver integrated circuit 261, or the touch circuit.

According to various embodiments, the display 260 may support various scanning rates. For example, the display 260 may support, although not limited to, scanning rates of 30 Hz, 48 Hz, 60 Hz, 90 Hz, 96 Hz, and 120 Hz. A screen of the display 260 may be refreshed according to the second synchronization period dynamically determined based on the currently executed application.

According to various embodiments of the present disclosure, an electronic device (e.g., the electronic device 101 of FIG. 1, the electronic device 201 of FIG. 2) may comprise: a display (e.g., the display module 160 of FIG. 1, the display 260 of FIG. 2); a processor (e.g., the processor 120 of FIG. 1, the processor 210 of FIG. 2) operatively connected to the display; and a memory (e.g., the memory 130 of FIG. 1, the memory 230 of FIG. 2) operatively connected to the processor, wherein the memory stores instructions which, when executed, cause the processor to: identify a frame rate of a first currently executed application; based on the frame rate, determine a scanning rate of the display and a frame refresh rate for refreshing a frame related to the first application; and control a screen refresh of the first application, based on the scanning rate and the frame refresh rate.

According to various embodiments, the memory may further store instructions which, when executed, cause the processor to: identify a time for displaying the frame on the display after being generated; determine an offset, based on the time for display; and apply the determined offset to control the screen refresh.

According to various embodiments, the instructions for determining of the scanning rate may comprise instructions for determining that, among scanning rates supported by the display, a scanning rate having a smallest difference from a multiple of the frame rate is configured as the scanning rate.

According to various embodiments, the instructions for determining of the scanning rate may comprise instructions for determining that a next-ranked scanning rate is configured as the scanning rate, based on current consumption of the display according to each scanning rate.

According to various embodiments, the instructions for determining of the frame refresh rate may determine the frame refresh rate to a value closest to the frame rate among values corresponding to divisors of the determined scanning rate.

According to various embodiments, the time for display may comprise a layer synthesis time for synthesizing at least one layer for generation of the frame, and a buffering time for storing the synthesized layer in a buffer memory.

According to various embodiments, the instructions for determining of the offset may determine the offset based on a waiting time until a second synchronization period according to the scanning rate after buffering is completed according to a first synchronization period according to the frame refresh rate.

According to various embodiments, the instructions for determining of the frame rate may determine the frame rate based on at least one of a value configured by a user, a previously stored value, a state of the first application, a maximum frame rate, an average frame rate, big data with respect to the first application, or information collected through machine learning.

According to various embodiments, the memory may further store instructions which, when executed, cause the processor to: periodically collect at least one of the time for display or the frame rate during execution of the first application; and based on a result of the collection, determine whether to re-change the determined scanning rate, the determined frame refresh rate, and the determined offset.

According to various embodiments, the memory may further store instructions which, when executed, cause the processor to: when a second application is executed, identify at least one of a frame rate of the second application or a time for display related to the second application; and determine at least one of a scanning rate, a frame refresh rate, or an offset for controlling a screen refresh of the second application, based on at least one of the identified frame rate and the identified time for display.

Figure 3A:
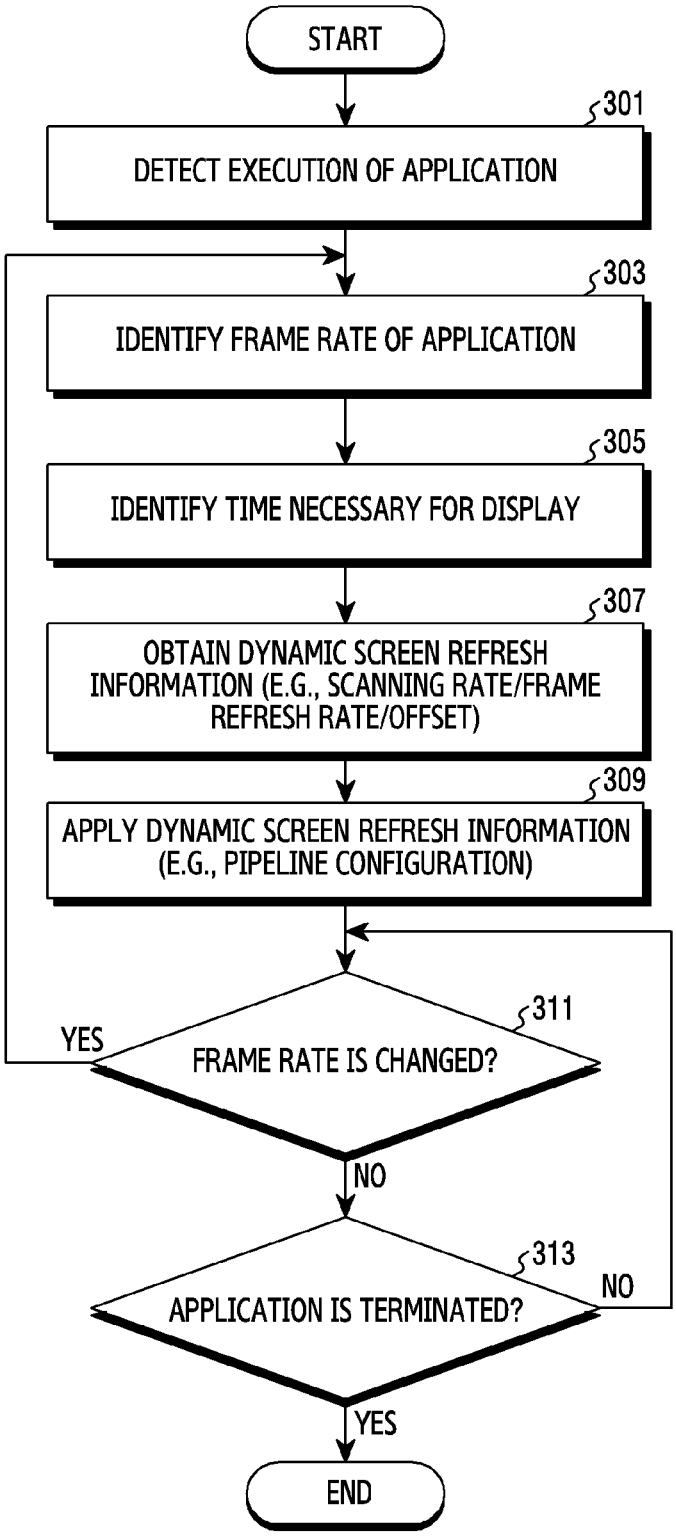
FIG. 3A illustrates a flowchart of a screen refresh method according to an embodiment.

FIG. 3A illustrates a flowchart of a screen refresh method according to an embodiment.

Referring to FIG. 3A, in operation 301, a processor (e.g., the processor 120 of FIG. 1 and the processor 210 of FIG. 2) of an electronic device (e.g., the electronic device 101 of FIG. 1 and the electronic device 201 of FIG. 2) according to an embodiment may detect execution (or change) of an application.

The processor according to an embodiment may identify a frame rate of the application in operation 303. For example, the processor may identify the frame rate of the currently executed application, through various methods. The method for identifying the frame rate will be described in detail with reference to FIG. 4.

In operation 305, the processor according to an embodiment may identify a time for display. The time for display may include a layer synthesis time for synthesizing a plurality of layers configuring one screen (frame) and/or a buffering time for storing the synthesized layer in a buffer memory (e.g., the buffer memory 61).

In operation 307, the processor according to an embodiment may obtain (determine) dynamic screen refresh information. For example, the processor may obtain (determine) a scanning rate of a display (e.g., the display module 160 of FIG. 1 and the display 260 of FIG. 2) and a frame refresh rate of the application, based on the frame rate identified in operation 303. The scanning rate may be determined as one or the most similar value among multiples (for example, 2 times, 3 times, 4 times, and 5 times) of the frame rate identified in operation 303, and the frame refresh rate may be determined as one or the most similar value among divisors of the determined scanning rate. In addition, the processor may obtain (determine) an offset based on the time for display identified in operation 305. The method for determining the dynamic screen refresh information will be described in detail with reference to FIG. 6.

In operation 309, the processor according to an embodiment may control a screen refresh by applying the determined dynamic screen refresh information. For example, the processor may configure a pipeline optimized for the currently executed application, based on the frame refresh rate, the scanning rate, and/or the offset which are obtained in operation 307. The description relating thereto will be described with reference to FIGS. 3B and 3C.

In operation 311, the processor according to an embodiment may identify whether the frame rate is changed. For example, the processor may periodically identify whether the frame rate is changed by a specified threshold value or more (for example, 10 FPS). According to an embodiment, the processor may identify whether another application is executed or the frame rate is changed by switching into an idle screen (for example, a home screen).

As the result of the identification of operation 311, in the case where the frame rate is changed, the processor may return to operation 303 and repeat the above-described operations. On the other hand, in the case where the frame rate is not changed as the result of the identification of operation 311, in operation 313, the processor may identify whether the application is terminated.

As the result of the identification of operation 313, in the case where the application is not terminated, the processor may return to operation 311 and repeat the above-described operations. On the other hand, in the case where the application is terminated as the result of the identification of operation 313, the processor may terminate control of the dynamic screen refresh.

According to an embodiment, the identifying of the time for display of operation 305 and the obtaining of the offset of operation 307 may be omitted. For example, the electronic device (e.g., the processor) may omit offset configuration when there is no problem with latency even if the offset is not configured (for example, a case where the scanning rate is more than 4 times the frame refresh rate), or when the latency is not important.

Figure 3B:
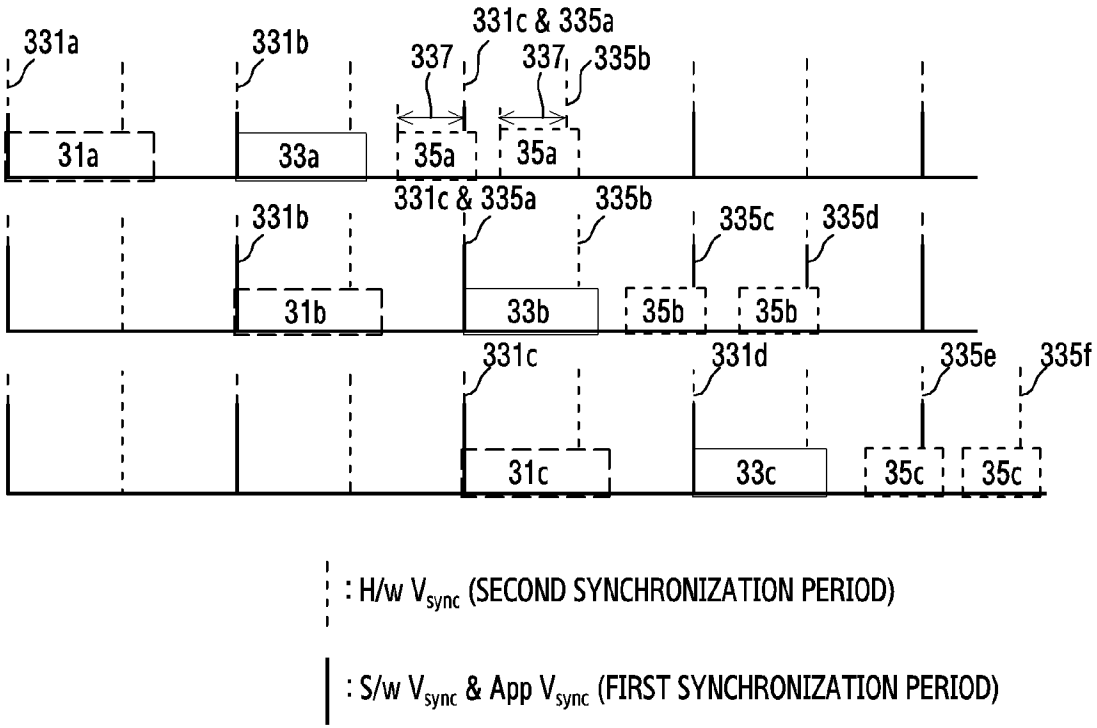
FIG. 3B illustrates a diagram of a pipeline for a screen refresh of an electronic device according to an embodiment.
Figure 3C:
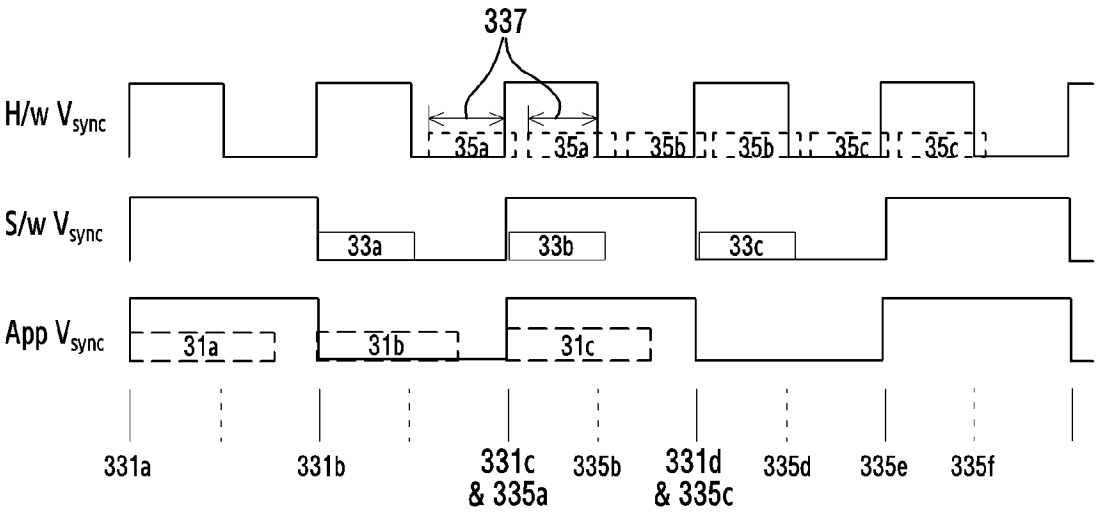
FIG. 3C illustrates a timing diagram of synchronization signals for a screen refresh of an electronic device according to an embodiment.

FIG. 3B illustrates a diagram of a pipeline for a screen refresh of an electronic device according to an embodiment, and FIG. 3C illustrates a timing diagram of synchronization signals for a screen refresh of an electronic device according to an embodiment.

Prior to the detailed description, hereinafter, for the convenience of explanation, it is assumed that the scanning rate of the display is 2 times the frame refresh rate.

Referring to FIGS. 3B and 3C, a currently executed application may draw an image to be displayed on the display, in units of frames, according to a first synchronization period (hereinafter, referred to as app draw). For example, the currently executed application may draw a first image 31*a* at a first time point 331*a* of the first synchronization period, draw a second image 31*b* at a second time point 331*b* of the first synchronization period, and draw a third image 31*c* at a third time point 331*c* of the first synchronization period.

According to an embodiment, the processor may generate a frame by synthesizing at least one layer according to the first synchronization period, and store the frame in a buffer memory (e.g., the buffer memory 61). For example, the processor (e.g., a SurfaceFlinger module) may synthesize at least one layer configuring a screen, and generate a first frame 33*a* at the second time point 331*b* of the first synchronization period to store the first frame in the buffer memory, generate a second frame 33*b* at the third time point 331*c* to store the second frame in the buffer memory, and generate a third frame 33*c* at a fourth time point 331*d* of the first synchronization period to store the third frame in the buffer memory.

When the storing of the frame is completed, the display (e.g., the display module 160 of FIG. 1 and the display 260 of FIG. 2) may refresh the screen according to a second synchronization period. For example, a display driver integrated circuit (e.g., the display driver integrated circuit 261 of FIG. 2) included in the display may read the first frame 33*a* stored in the buffer memory at a time point obtained by adding an offset 337 to a first time point 335*a* of the second synchronization period and at a time point obtained by adding the offset 337 to a second time point 335*b*, so as to output a first screen 35*a* on the display. The display driver integrated circuit may read the second frame 33*b* at a time point obtained by adding the offset 337 to a third time point 335*c* of the second synchronization period and at a time point obtained by adding the offset 337 to a fourth time point 335*d*, so as to output a second screen 35*b* on the display. The display driver integrated circuit may read the third frame 33*c* at a time point obtained by adding the offset 337 to a fifth time point 335*e* of the second synchronization period and at a time point obtained by adding the offset 337 to a sixth time point 335*f*, so as to output a third screen 35*c* on the display.

According to various embodiments, the display driver integrated circuit may read the first frame 33*a* stored in the buffer memory at the time point obtained by adding the offset 337 to the first time point 335*a* of the second synchronization period, so as to output the first screen 35*a* on the display, and when the storing of the second frame 33*b*, which is the next frame, in the buffer memory is not completed at the time point obtained by adding the offset 337 to the second time point 335*b* of the second synchronization period, the display driver integrated circuit may re-output (for example, refresh) the first screen 35*a* on the display. For the similar reason, the display driver integrated circuit may read the second screen 35*b* at the time point obtained by adding the offset 337 to the fourth time point 335*d* of the second synchronization period, so as to re-output the second screen on the display, and may read the third screen 35*c* at the time point obtained by adding the offset 337 to the sixth time point 335*f* of the second synchronization period, so as to re-output the third screen on the display.

According to various embodiments, the operation of re-outputting the first screen 35*a* on the display at the time point obtained by adding the offset 337 to the second time point 335*b* of the second synchronization period may be omitted in the case where the first screen 35*a* output on the display at the time point obtained by adding the offset 337 to the first time point 335*a* of the second synchronization period is maintained by the display's own function. Similarly, the operation of re-outputting the second screen 35*b* on the display at the time point obtained by adding the offset 337 to the fourth time point 335*d* of the second synchronization period, and the operation of re-outputting the third screen 35*c* on the display at the time point obtained by adding the offset 337 to the sixth time point 335*f* of the second synchronization period may be omitted.

Figure 4:
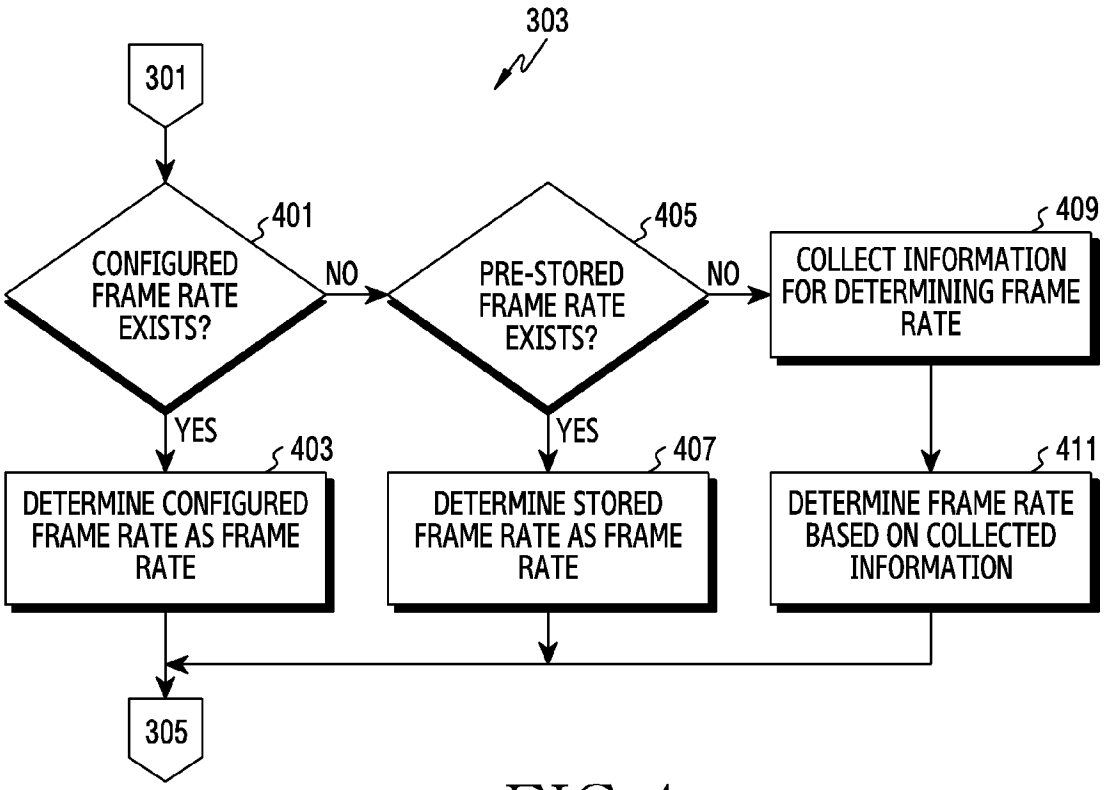
FIG. 4 illustrates a flowchart of a method for identifying a frame rate according to an embodiment.

FIG. 4 illustrates a flowchart of a method for identifying a frame rate according to an embodiment.

Referring to FIG. 4, in operation 401, a processor (e.g., the processor 120 of FIG. 1 and the processor 210 of FIG. 2) of an electronic device (e.g., the electronic device 101 of FIG. 1 and the electronic device 201 of FIG. 2) according to an embodiment may identify whether a configured frame rate exists. For example, when the executed application is an application which can configure a frame rate by a user, the processor may identify whether the frame rate configured by the user exists.

As the result of the identification of operation 401, in the case where the configured frame rate exists, the processor may determine the configured frame rate as the frame rate of the currently executed application in operation 403. On the other hand, as the result of the identification of operation 401, in the case where the configured frame rate does not exist, in operation 405, the processor may identify whether a previously stored frame rate exists. For example, the processor may identify whether a previously stored (used) frame rate exists, through history information of the executed application.

As the result of the identification of operation 405, in the case where the previously stored frame rate exists, in operation 407, the processor may determine the stored frame rate as the frame rate of the currently executed application. On the other hand, in the case where the stored frame rate does not exist as the result of the identification of operation 405, in operation 409, the processor may collect information for determining the frame rate. For example, the processor may collect systrace or gfxinfo information (e.g., janky frames). According to another example, the processor may collect maximum frame rate or average frame rate information of the currently executed application. According to another example, the processor may collect machine learning information or big data with respect to the currently executed application. As another example, the processor may receive, from a server, machine learning information or big data related to the frame rate of the currently executed application. According to another embodiment, the processor may collect information on an application state (e.g., loading, a specific mode (e.g., a manual combat or an automatic combat), and an idle screen).

In operation 411, the processor according to an embodiment may determine the frame rate of the currently executed application, based on the collected information.

When the frame rate of the currently executed application is determined, the processor may proceed to operation 305 of FIG. 3.

Figure 5:
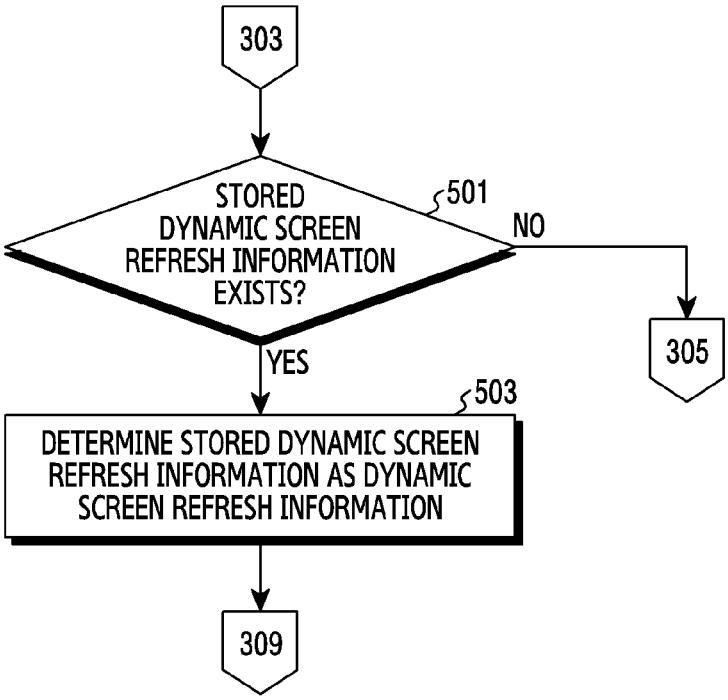
FIG. 5 illustrates a flowchart of a method for determining dynamic screen refresh information according to an embodiment.

FIG. 5 illustrates a flowchart of a method for determining dynamic screen refresh information according to an embodiment.

Referring to FIG. 5, in operation 501, a processor (e.g., the processor 120 of FIG. 1 and the processor 210 of FIG. 2) of an electronic device (e.g., the electronic device 101 of FIG. 1 and the electronic device 201 of FIG. 2) according to an embodiment may identify whether previously stored dynamic screen refresh information exists. For example, the processor may identify whether a previously stored scanning rate, frame refresh rate, and/or offset associated with the currently executed application exists.

As the result of the identification of operation 501, in the case where the previously stored dynamic screen refresh information does not exist, the processor may proceed to operation 305 of FIG. 3. On the other hand, as the result of the identification of operation 501, in the case where the previously stored dynamic screen refresh information exists, in operation 503, the processor may determine the previously stored dynamic screen refresh information as dynamic screen refresh information.

When the dynamic screen refresh information is determined, the processor may proceed to operation 309 of FIG. 3.

Figure 6:
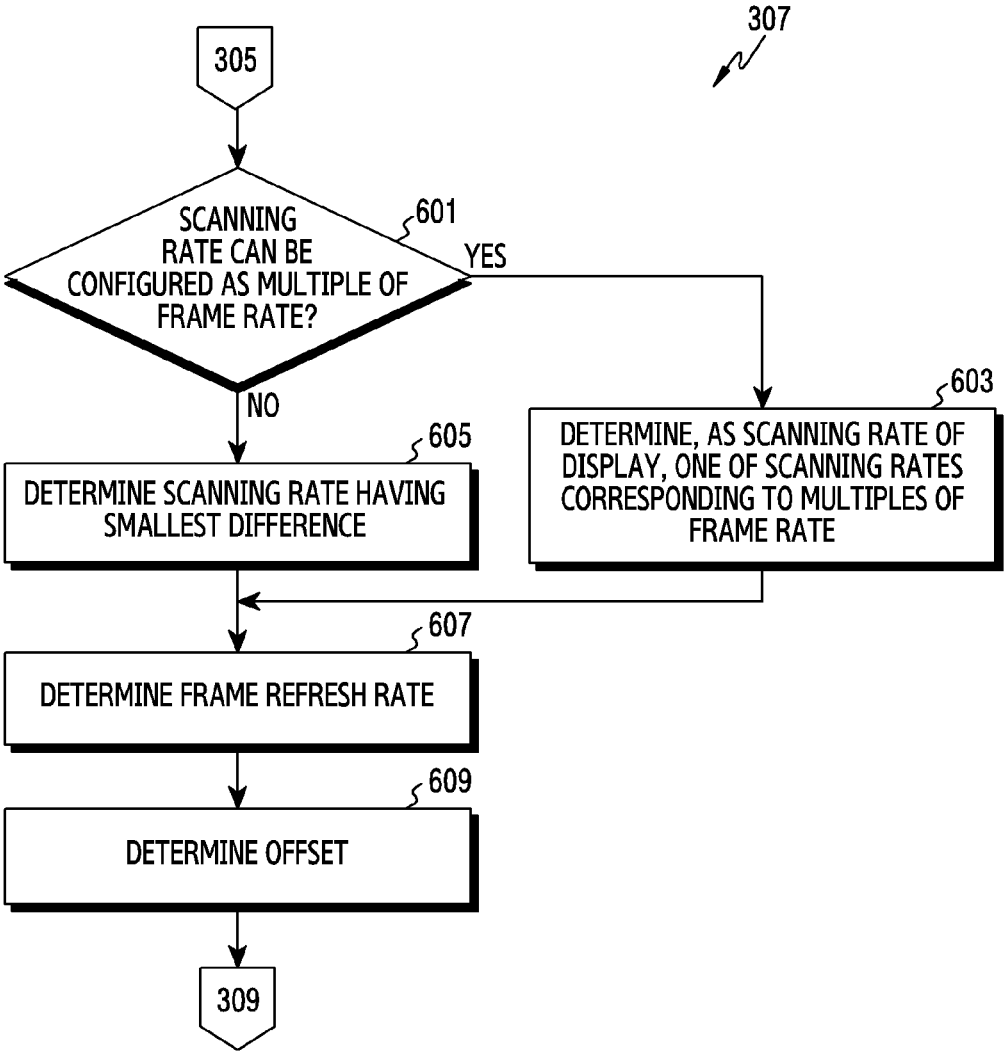
FIG. 6 illustrates a flowchart of a method for obtaining dynamic screen refresh information according to an embodiment.

FIG. 6 illustrates a flowchart of a method for obtaining dynamic screen refresh information according to an embodiment.

Referring to FIG. 6, in operation 601, a processor (e.g., the processor 120 of FIG. 1 and the processor 210 of FIG. 2) of an electronic device (e.g., the electronic device 101 of FIG. 1 and the electronic device 201 of FIG. 2) according to an embodiment may identify whether a scanning rate can be configured as a multiple of a frame rate. For example, the processor may identify whether a display (e.g., the display module 160 of FIG. 1 and the display 260 of FIG. 2) supports a scanning rate corresponding to the multiple of the frame rate. For example, in the case where the frame rate is 33 FPS, the processor may identify whether the display supports a scanning rate of 66 (=33*2), 99 (=33*3), or 132 (=33*4).

As the result of the identification of operation 601, in the case where the scanning rate can be configured as the multiple of the frame rate, the processor may determine, as the scanning rate of the display, the scanning rate corresponding to the multiple of the frame rate in operation 603. For example, when the display supports scanning rates of 30 Hz, 48 Hz, 60 Hz, 90 Hz, 96 Hz, and 120 Hz, the processor may determine, as the scanning rate of the display, 96 Hz which corresponds to 3 times the frame rate (33 FPS).

According to an embodiment, when there are a plurality of scanning rates corresponding to the multiple of the frame rate, the processor may determine the scanning rate of the display in consideration of current consumption and latency. For example, in the case where the frame rate is 30 FPS, the scanning rate of the display may be configured to be one of 30 (=30*1) Hz, 60 (=30*2) Hz, 90 (=30*3) Hz, and 120 (=30*4) Hz. In this case, the processor may preferentially select 120 Hz in consideration of the latency, but when operating at 120 Hz, a problem with the current consumption (for example, an increase in current consumption) may occur. Accordingly, the processor may determine 90 Hz (or 60 Hz), which is ranked next, as the scanning rate of the display.

As the result of the identification of operation 601, in the case where the scanning rate cannot be configured as the multiple of the frame rate, in operation 605, the processor may determine the scanning rate having the smallest difference as the scanning rate of the display. For example, in the case where a frame rate of a currently executed application is 43 FPS, configurable scanning rates may be 43 (=43*1) Hz, 86 (=43*2) Hz, and 129 (=43*3) Hz. As shown in Table 2 below, the processor may determine, as the scanning rate of the display, 90 Hz which has the smallest difference from the configurable scanning rates among scanning rates supported by the display.

TABLE 2

| Multiple scanning rate (Hz) | Support scanning rate (Hz) | | | | | |
|---|---|---|---|---|---|---|
| | 30 | 48 | 60 | 90 | 96 | 120 |
| 43 | 13 | 5 | 17 | 47 | 53 | 77 |
| 86 | 56 | 38 | 26 | 4 | 10 | 34 |
| 129 | 99 | 81 | 69 | 39 | 33 | 9 |

According to an embodiment, even when the display supports the scanning rate corresponding to the multiple of the frame rate, the scanning rate of the display may be determined based on a next-ranked scanning rate in consideration of a consumption current problem. For example, in the case where the frame rate is 40 FPS, a configurable scanning rate may be 40 (=40*1) Hz, 80 (=40*2) Hz, and 120 (=40*3) Hz. The processor can configure 120 Hz, which is 3 times the frame rate, as the scanning rate of the display, but may determine, as the scanning rate of the display, 90 Hz which is most similar to 80 Hz which is a next-ranked configurable scanning rate, in consideration of current consumption.

The processor according to an embodiment may determine a frame refresh rate in operation 607. The processor may determine the frame refresh rate as a value similar to the frame rate among divisors of the determined scanning rate of the display. For example, in the case where the frame rate is 33 FPS and the scanning rate is determined to be 96 Hz, the processor may determine, as the frame refresh rate, 32 Hz which is the most similar to 33 FPS among 48 (=96/2) Hz, 32 (=96/3) Hz, and 24 (=96/4) Hz which are divisors of the scanning rate (96 Hz). As another example, in the case where the frame rate is 40 FPS and the scanning rate is determined to be 120 Hz, the processor may determine, as the frame refresh rate, 40 Hz which is most similar to 40 FPS among 60 (=120/2) Hz, 40 (=120/3) Hz, 30 (=120/4) Hz, and 24 (=120/5) Hz which are divisors of the scanning rate (120 Hz).

The processor according to an embodiment may determine an offset in operation 609. The processor may determine the offset based on the time for display identified in operation 305 of FIG. 3. For example, when the time for display is short and thus a waiting time is long, the processor may reduce the waiting time by configuring the offset to have a first value (a relatively large value compared to a second value). Alternatively, when the time for display is long and thus the waiting time is short, the processor may configure or may not configure the offset to have the second value (a relatively small value compared to the first value). According to various embodiments, the processor may configure the offset by controlling a phase of a first synchronization signal related to a frame refresh rate or a second synchronization signal related to a scanning rate. When the offset is determined, the processor may proceed to operation 309 of FIG. 3.

According to an embodiment, operation 609 may be omitted. For example, operation 609 of configuring an offset when there is no problem with latency even if the offset is not configured (for example, a case where the scanning rate is more than 4 times the frame refresh rate), or when the latency is not important may be omitted.

Figure 7:
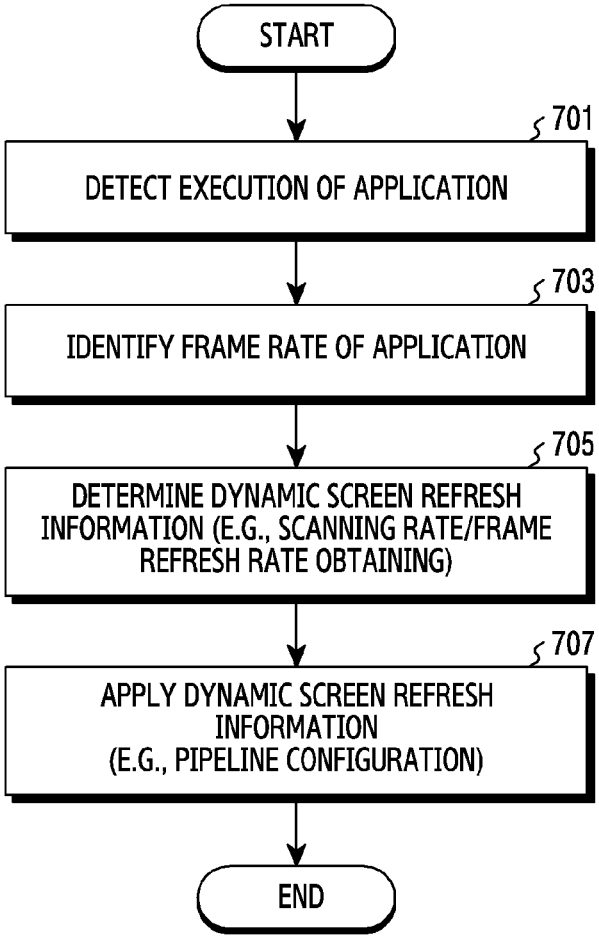
FIG. 7 illustrates a flowchart of a screen refresh method according to an embodiment.

FIG. 7 illustrates a flowchart of a screen refresh method according to an embodiment.

Referring to FIG. 7, in operation 701, a processor (e.g., the processor 120 of FIG. 1 and the processor 210 of FIG. 2) of an electronic device (e.g., the electronic device 101 of FIG. 1 and the electronic device 201 of FIG. 2) according to an embodiment may detect execution (or change) of an application.

The processor according to an embodiment may identify a frame rate of the application in operation 703. For example, the processor may identify the frame rate of the currently executed application, through various methods. The method for identifying the frame rate has been described above with reference to FIG. 4, and thus the detailed description thereof will be omitted.

The processor according to an embodiment may determine dynamic screen refresh information in operation 705. For example, the processor may obtain a scanning rate of a display (e.g., the display module 160 of FIG. 1 and the display 260 of FIG. 2) and a frame refresh rate of the application, based on the frame rate identified in operation 703. The scanning rate may be determined as one or the most similar value among multiples (for example, 2 times, 3 times, 4 times, and 5 times) of the frame rate identified in operation 703, and the frame refresh rate may be determined as one or the most similar value among divisors of the determined scanning rate.

In operation 707, the processor according to an embodiment may control a screen refresh of the application by applying the determined dynamic screen refresh information. For example, the processor may configure a pipeline optimized for the currently executed application, based on the frame refresh rate and scanning rate obtained in operation 705.

Operations 703 to 707 described above may be re-performed when the frame rate of the currently executed application is changed by a specified value or more (for example, increases or decreases by 10 FPS or more), or the currently executed application (a first application) is changed to another application (a second application).

According to various embodiments of the present disclosure, a screen refresh method of an electronic device (e.g., the electronic device 101 of FIG. 1, the electronic device 201 of FIG. 2) may comprise: identifying a frame rate of a first currently executed application; determining a scanning rate of a display (e.g., the display module 160 of FIG. 1, the display 260 of FIG. 2), based on the frame rate; determining a frame refresh rate for refreshing a frame related to the first application, based on the determined scanning rate; and controlling a screen refresh of the first application, based on the determined scanning rate and the determined frame refresh rate.

According to various embodiments, the method may further comprise: identifying a time for displaying the frame on the display after being generated; and determining an offset, based on the time for display. The controlling of the screen refresh of the first application may comprise controlling the screen refresh by further applying the determined offset.

According to various embodiments, the determining of the scanning rate may comprise determining, as the scanning rate, a scanning rate having a smallest difference from a multiple of the frame rate, among scanning rates supported by the display.

According to various embodiments, the determining of the scanning rate may comprise determining a next-ranked scanning rate as the scanning rate, based on current consumption of the display according to each scanning rate.

According to various embodiments, the determining of the frame refresh rate may comprise determining the frame refresh rate to a value closest to the frame rate among values corresponding to divisors of the determined scanning rate.

According to various embodiments, the time for display may comprise a layer synthesis time for synthesizing at least one layer for generation of the frame, and a buffering time for storing the synthesized layer in a buffer memory.

According to various embodiments, the determining of the offset may comprise determining the offset based on a waiting time until a second synchronization period related to the scanning rate after buffering is completed according to a first synchronization period according to the frame refresh rate.

According to various embodiments, the determining of the frame rate may comprise at least one of: determining, as the frame rate, a value configured by a user; determining, as the frame rate, a value previously stored in a use history of the first application; determining, as the frame rate, a value mapped to a state of the first application; determining, as the frame rate, a maximum frame rate or an average frame rate of the first application; or determining the frame rate based on at least one of big data with respect to the first application or information collected through machine learning.

According to various embodiments, the method may further comprise: periodically collecting at least one of the time for display or the frame rate during execution of the first application; and based on a result of the collection, determining whether to re-change at least one of the determined scanning rate, the determined frame refresh rate, and the determined offset.

According to various embodiments, the method may further comprise: when a second application is executed, identifying at least one of a frame rate of the second application or a time for display related to the second application; and determining at least one of a scanning rate, a frame refresh rate, or an offset for controlling a screen refresh of the second application, based on at least one of the identified frame rate and the identified time for display.

In the electronic device according to various embodiments, since frame drop does not occur, a screen refresh may be uniform and a smooth screen change may be provided. In addition, the electronic device according to various embodiments can prevent latency delay for user interaction. For example, various embodiments can improve user satisfaction with the electronic device.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used in connection with various embodiments of the disclosure, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PLAYSTORE), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities, and some of the multiple entities may be separately disposed in different components. According to various embodiments, one or more of the above-described components may be omitted, or one or more other components may be added.

Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Although the present disclosure has been described with various embodiments, various changes and modifications may be suggested to one skilled in the art. It is intended that the present disclosure encompass such changes and modifications as fall within the scope of the appended claims.

What is claimed is:

1. An electronic device comprising:

a display; and a processor operatively connected to the display, wherein the processor is configured to:

identify a frame rate of a first application that is currently being executed, based on the frame rate, determine a scanning rate of the display, based on the frame rate and the determined scanning rate, determine a frame refresh rate for refreshing a frame related to the first application by determining the frame refresh rate as a value closest to the frame rate among values corresponding to divisors of the determined scanning rate, and control a first screen refresh of the first application, based on the scanning rate and the frame refresh rate.

2. The electronic device of claim 1, wherein the processor is further configured to:

identify a time after the frame is generated until the frame is displayed on the display;

determine a first offset, based on the identified time; and apply the determined first offset to control the first screen refresh.

3. The electronic device of claim 2, wherein the identified time comprises a layer synthesis time for synthesizing at least one layer for generation of the frame, and a buffering time for storing the synthesized layer in a buffer memory.

4. The electronic device of claim 3, wherein to determine the first offset, the processor is configured to determine the first offset based on a waiting time until a second synchronization period according to the scanning rate after buffering is completed according to a first synchronization period according to the frame refresh rate.

5. The electronic device of claim 2, wherein the processor is further configured to:

periodically collect at least one of the identified time or the frame rate during execution of the first application; and based on a result of the collection, determine whether to re-change the determined scanning rate, the determined frame refresh rate, and the determined first offset.

6. The electronic device of claim 2, wherein the processor is further configured to:

when a second application is executed, identify at least one of a frame rate of the second application or a time after a frame related to the second application is generated until the frame is displayed on the display; and determine at least one of a scanning rate, a frame refresh rate, or a second offset for controlling a second screen refresh of the second application, based on at least one of the identified frame rate of the second application and the identified time of the second application.

7. The electronic device of claim 1, wherein to determine the scanning rate, the processor is configured to determine a scanning rate, including a smallest difference from a multiple of the frame rate, among scanning rates supported by the display as the scanning rate.

8. The electronic device of claim 7, wherein to determine the scanning rate, the processor is configured to determine a next-ranked scanning rate as the scanning rate, based on current consumption of the display according to each of the scanning rates.

9. The electronic device of claim 7, wherein the smallest difference from a multiple of the frame rate is non-zero.

10. The electronic device of claim 1, wherein to determine the frame rate, the processor is configured to determine the frame rate based on at least one of:

a value configured by a user;

a previously stored value;

a state of the first application;

a maximum frame rate;

an average frame rate;

big data with respect to the first application; or information collected through machine learning.

11. A screen refresh method of an electronic device, the screen refresh method comprising:

identifying a frame rate of a first application that is currently being executed;

determining a scanning rate of a display, based on the frame rate;

determining a frame refresh rate for refreshing a frame related to the first application, based on the determined scanning rate by determining the frame refresh rate as a value closest to the frame rate among values corresponding to divisors of the determined scanning rate; and controlling a first screen refresh of the first application, based on the determined scanning rate and the determined frame refresh rate.

12. The screen refresh method of claim 11, further comprising:

identifying a time after the frame is generated until the frame is displayed on the display; and determining a first offset, based on the identified time, wherein the controlling of the first screen refresh of the first application comprises controlling the first screen refresh by further applying the determined first offset.

13. The screen refresh method of claim 12, wherein identifying the time comprises:

identifying a layer synthesis time for synthesizing at least one layer for generation of the frame; and identifying a buffering time for storing the synthesized layer in a buffer memory.

14. The screen refresh method of claim 13, wherein determining the first offset comprises determining the first offset based on a waiting time until a second synchronization period related to the scanning rate after buffering is completed according to a first synchronization period according to the frame refresh rate.

15. The screen refresh method of claim 12, further comprising:

periodically collecting at least one of the identified time or the frame rate during execution of the first application; and based on a result of the collection, determining whether to re-change at least one of the determined scanning rate, the determined frame refresh rate, and the determined first offset.

16. The screen refresh method of claim 12, further comprising:

when a second application is executed, identifying at least one of a frame rate of the second application or a time after a frame related to the second application is generated until the frame is displayed on the display; and determining at least one of a scanning rate, a frame refresh rate, or a second offset for controlling a second screen refresh of the second application, based on at least one of the identified frame rate of the second application and the identified time of the second application.

17. The screen refresh method of claim 11, wherein determining the scanning rate comprises determining, as the scanning rate, a scanning rate including a smallest difference from a multiple of the frame rate, among scanning rates supported by the display.

18. The screen refresh method of claim 17, wherein determining the scanning rate comprises determining a next-ranked scanning rate as the scanning rate, based on current consumption of the display according to each of the scanning rates.

19. The screen refresh method of claim 17, wherein the smallest difference from a multiple of the frame rate is non-zero.

20. The screen refresh method of claim 11, wherein determining the frame rate comprises at least one of:

determining, as the frame rate, a value configured by a user;

determining, as the frame rate, a value previously stored in a use history of the first application;

determining, as the frame rate, a value mapped to a state of the first application;

determining, as the frame rate, a maximum frame rate or an average frame rate of the first application; or determining the frame rate based on at least one of big data with respect to the first application or information collected through machine learning.

* * * * *